US006000538A

United States Patent [19]

Lee

[11] Patent Number: 6,000,538

[45] Date of Patent: Dec. 14, 1999

[54] TOILET PAPER HOLDER

[76] Inventor: Jen-Song Lee, 7th Floor, 15 Alley 33, Lane 216, Section 4, Chung-Hsia-Tong Road, Ta-An District, Taipei, Taiwan

[21] Appl. No.: 09/232,180

[22] Filed: Jan. 15, 1999

[51] Int. Cl.[6] ..... B65D 69/00

[52] U.S. Cl. ..... 206/233; 206/494; 221/48; 221/49; 220/812

[58] Field of Search ..... 206/233, 494; 220/811, 813, 812; 221/22, 25, 28, 46, 48, 49

[56] References Cited

U.S. PATENT DOCUMENTS

| | | | |
|---|---|---|---|
| 3,994,417 | 11/1976 | Boedecker | 221/48 |
| 4,369,119 | 1/1983 | Giulie | 220/812 |
| 5,213,243 | 5/1993 | Landon | 206/233 |
| 5,358,140 | 10/1994 | Pellegrino | 206/494 |
| 5,531,325 | 7/1996 | Deflander et al. | 221/49 |

*Primary Examiner*—David T. Fidei

*Attorney, Agent, or Firm*—W. Wayne Liauh

[57] ABSTRACT

A toilet paper holder is made up of a main body and a movable lid. The main body is provided therein with a receiving space for holding toilet paper sheets which are arranged in a stack in an organized manner such that the toilet paper sheets can be drawn out one after another. The movable lid is provided with a through hole through which the toilet paper sheets contained in the main body are drawn out. The main body is provided in two opposite side walls thereof with a short slide slot and a long slide slot. The movable lid is provided in the longitudinal side edge thereof with an adjustment rod which can be retained at both ends thereof in the slide slots of the main body so as to adjust the distance between the underside of the movable lid and the topmost sheet of the pile of the toilet paper sheets held in the receiving space of the main body. The movable lid has an arcuate underside to reduce the contact area between the underside of the lid and the topmost sheet of the toilet paper sheets. The movable lid is provided with a holding slot surrounding the through hole for retaining a label and the like.

4 Claims, 8 Drawing Sheets

TOILET PAPER HOLDER

FIELD OF THE INVENTION

The present invention relates generally to a toilet paper holder, and more particularly to a compressible toilet paper holder.

BACKGROUND OF THE INVENTION

As shown in FIG. 1, a toilet paper holder of the prior art is composed of a box body and a lid which is provided with a plurality of lugs which are retained in the retaining holes of the side walls of the box body. The lid can be lifted to facilitate the depositing of the toilet paper sheets in the box body. The lid is provided in the center thereof with an oval through hole through which the toilet paper sheets can be drawn out one after another. In other words, when the first toilet paper sheet is drawn out through the through hole of the lid, the second toilet paper sheet is partially drawn out through the through hole of the lid. However, the second (or subsequent) toilet paper sheet often fails to be partially drawn out through the through hole of the lid at the time when the number of the toilet paper sheets contained in the box body runs low. As a result, the user of the toilet paper must put his or her fingers through the oval through hole of the lid in order to draw the toilet paper sheet out, thereby causing a great deal of aggravation to the user of the toilet paper. When the overall volume of the toilet paper sheets contained in the box body is reduced to a certain extent, the distance between the lid and the topmost toilet paper sheet becomes so great that there is a lack of an appropriate connection length between the toilet paper sheet being drawn out and the following toilet paper sheet. As a result, the following toilet paper sheet is not partially drawn out of the oval through hole of the lid such that the following toilet paper sheet falls back into the box body.

SUMMARY OF THE INVENTION

It is therefore the primary objective of the present invention to provide an improved toilet paper holder which is free from the drawback of the toilet paper holder of the prior art described above.

It is another objective of the present invention to provide a toilet paper holder which is versatile in design to enhance its marketability.

In keeping with the principle of the present invention, the foregoing objectives of the present invention are attained by a toilet paper holder consisting of a main body and a movable lid. The main body is provided therein with a receiving space for holding toilet paper sheets which are arranged in a stack in an organized manner such that the toilet paper sheets can be drawn out one after another.

The movable lid is provided with a through hole through which the toilet paper sheets contained in the main body are drawn out. The main body is provided in two opposite side walls thereof with a short slide slot and a long slide slot. The movable lid is provided in the underside of a longitudinal side edge thereof with an adjustment rod which can be slid in the slide slots of the main body so as to adjust the distance between the lid and the topmost toilet paper sheet contained in the main body. The lid is of an arcuate construction capable of reducing the friction force of the drawing of the toilet paper sheet from the main body. The lid is provided in the upper surface thereof with a holding slot surrounding the through hole for retaining a label and the like.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
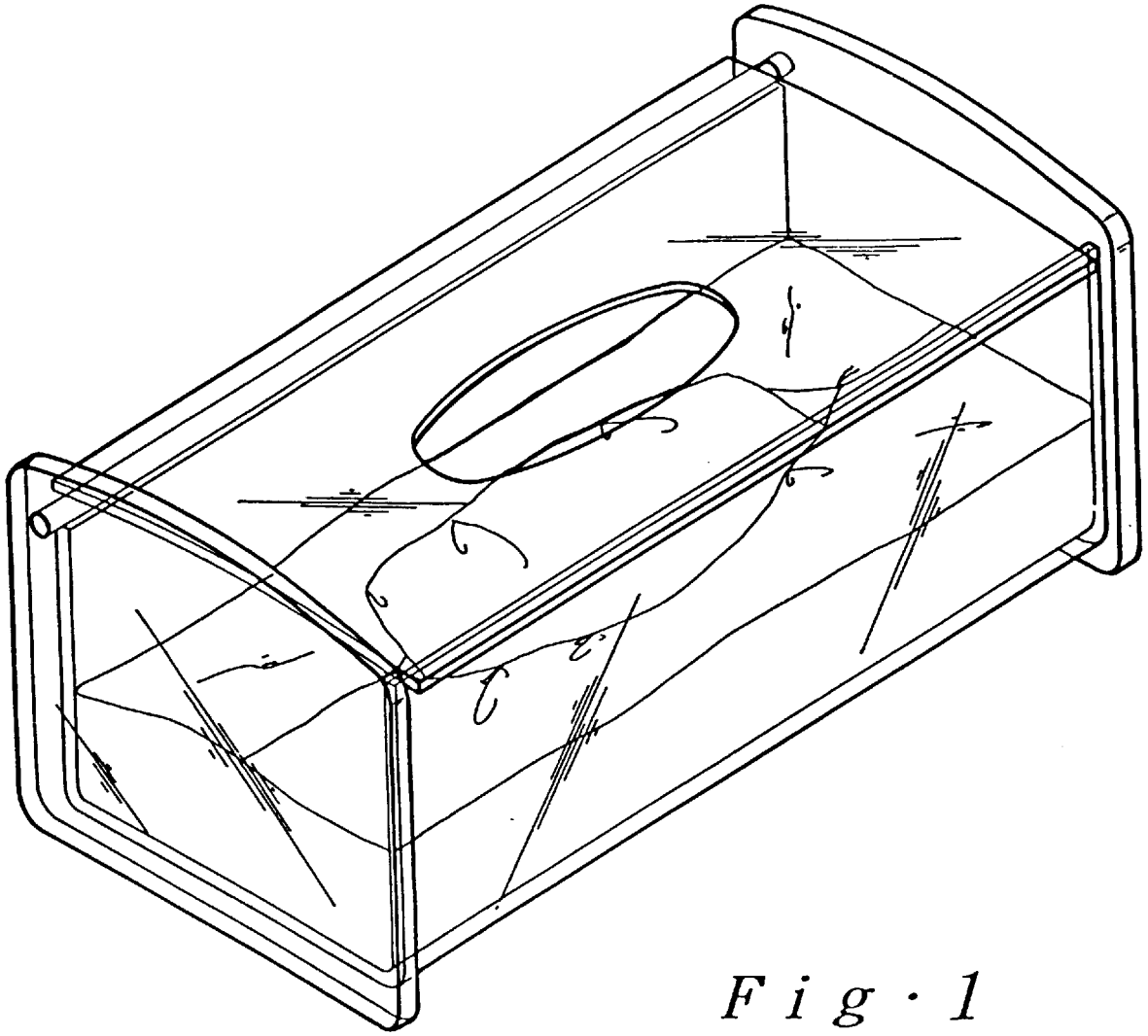
Fig. 1 PRIOR ART
FIG. 1 shows a schematic view of a toilet paper holder of the prior art.
Figure 2:
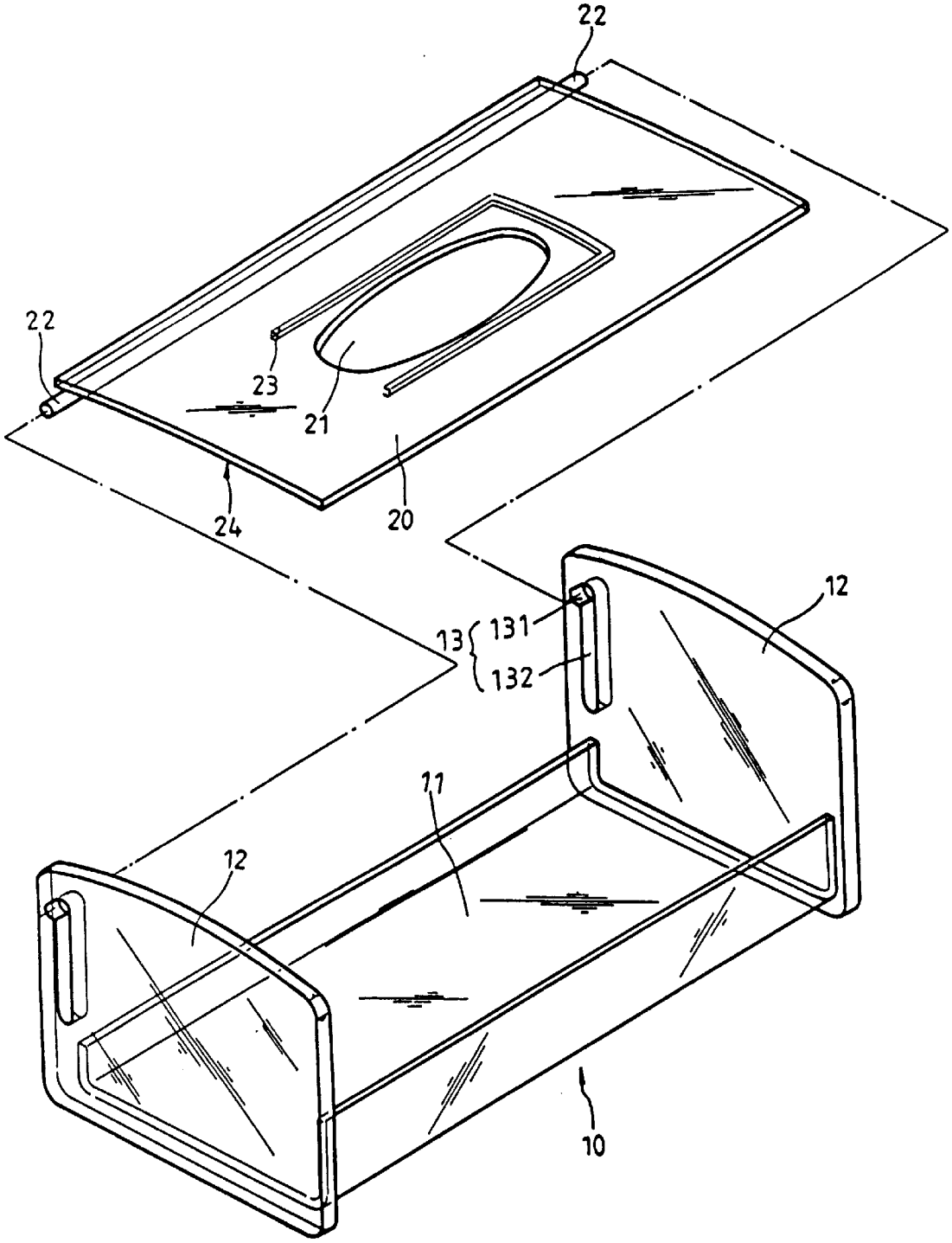
FIG. 2 shows an exploded view of a toilet paper holder of the present invention.
Figure 3:
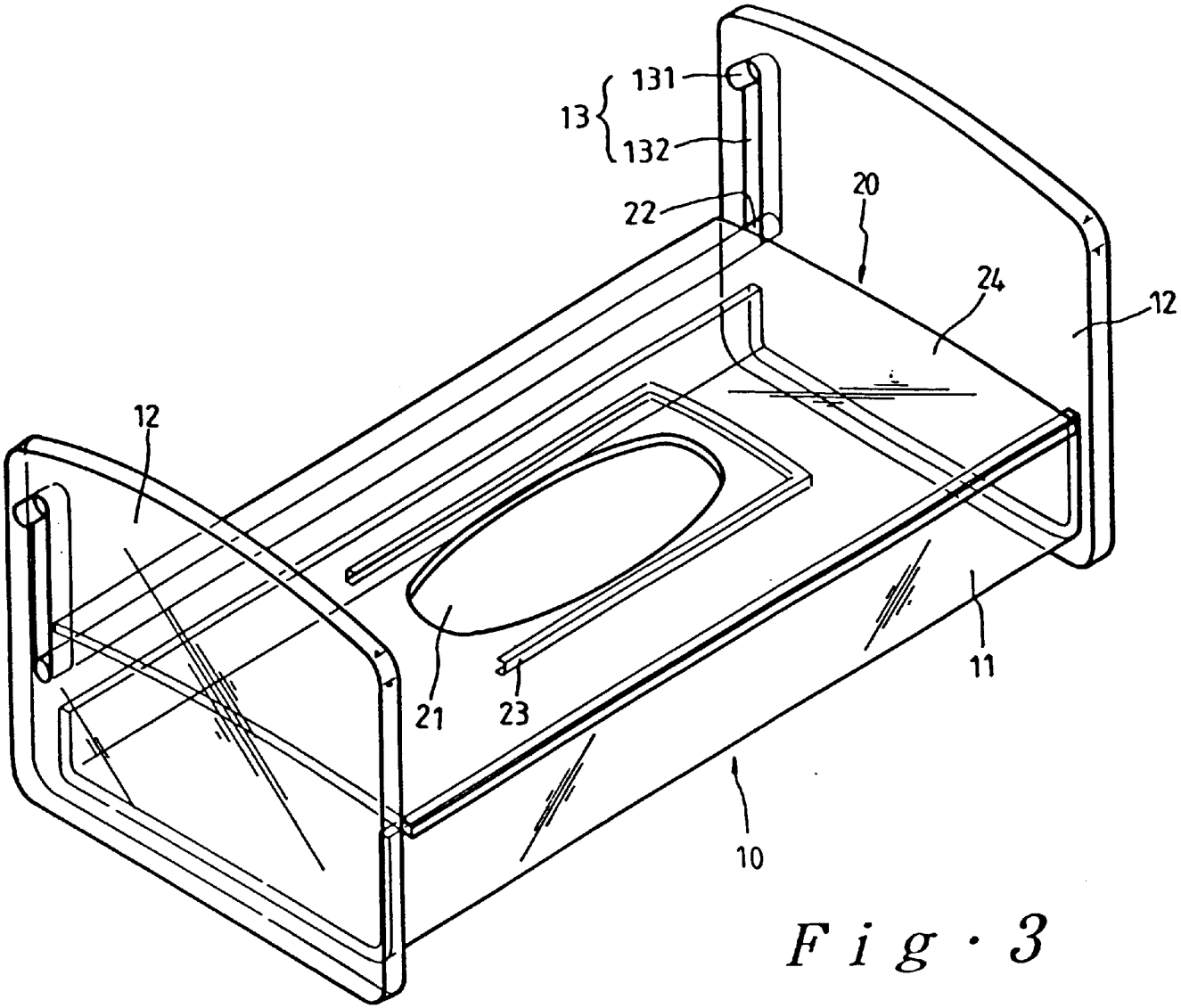
FIG. 3 shows a perspective view of the toilet paper holder of the present invention.
Figure 4:
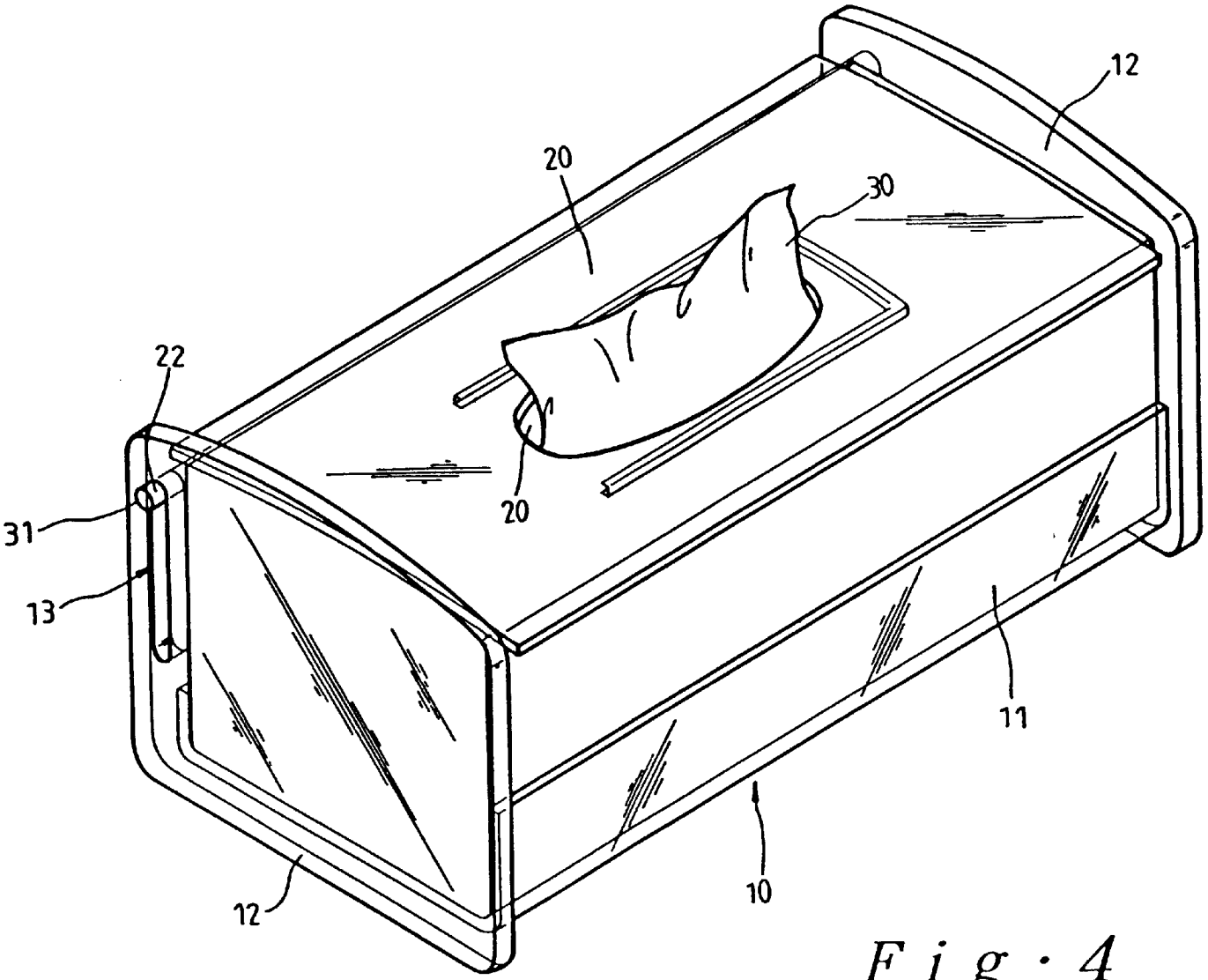
FIG. 4 shows a schematic view of the toilet paper holder of the present invention in use.

As shown in FIGS. 2, 3, and 4, a toilet paper holder embodied in the present invention is composed of a main body 10 and a movable lid 20. main body 10 has a rectangular base 11 and two side plates 12 fastened with two longitudinal ends of the base 11. A receiving space is thus formed and defined by the base 11 and the two side plates 12 for holding a pile of toilet paper sheets which are arranged in a stack in an organized manner such that the toilet paper sheets can be drawn out of the receiving space one after another. The two side plates 12 are provided correspondingly in the inner side thereof with a slide slot 13 consisting of a first slide slot 131 and a second slide slot 132 longer than the first slide slot 131.

The movable lid 20 has a slightly arcuate surface 24 and is provided with an adjustment rod 22 fastened therewith such that the adjustment rod 22 is corresponding in location to the slide slot 13 of the main body 10. The movable lid 20 is provided in the center thereof with an oval through hole 21 through which the toilet paper sheets 30 are drawn out of the main body 10. The movable lid 20 is further provided with a holding slot 23 surrounding the through hole 21.

Figure 5:
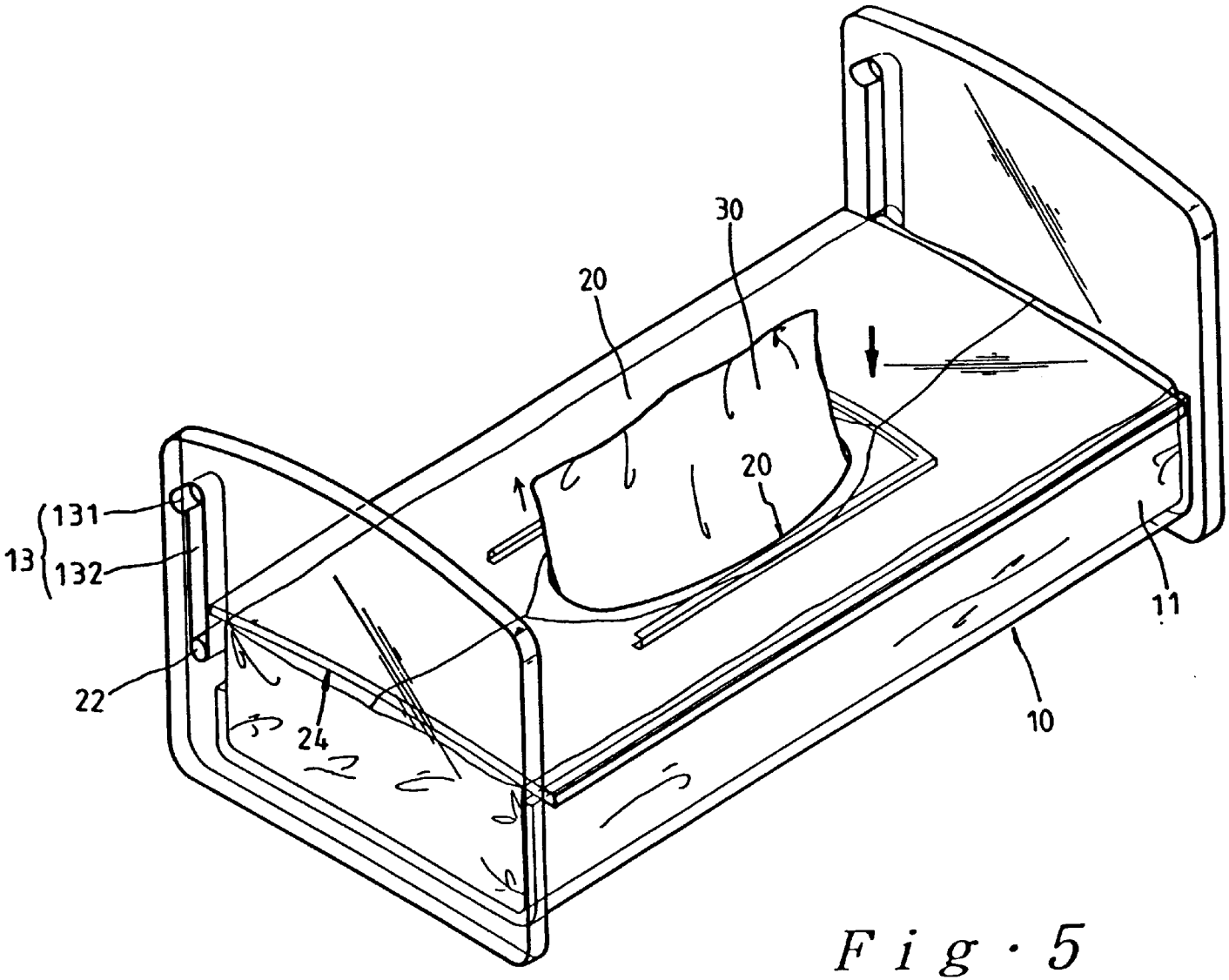
FIG. 5 is a schematic view showing that the movable lid of the present invention is lowered in response to a reduction in volume of the toilet paper contained in the main body of the present invention.
Figure 8:
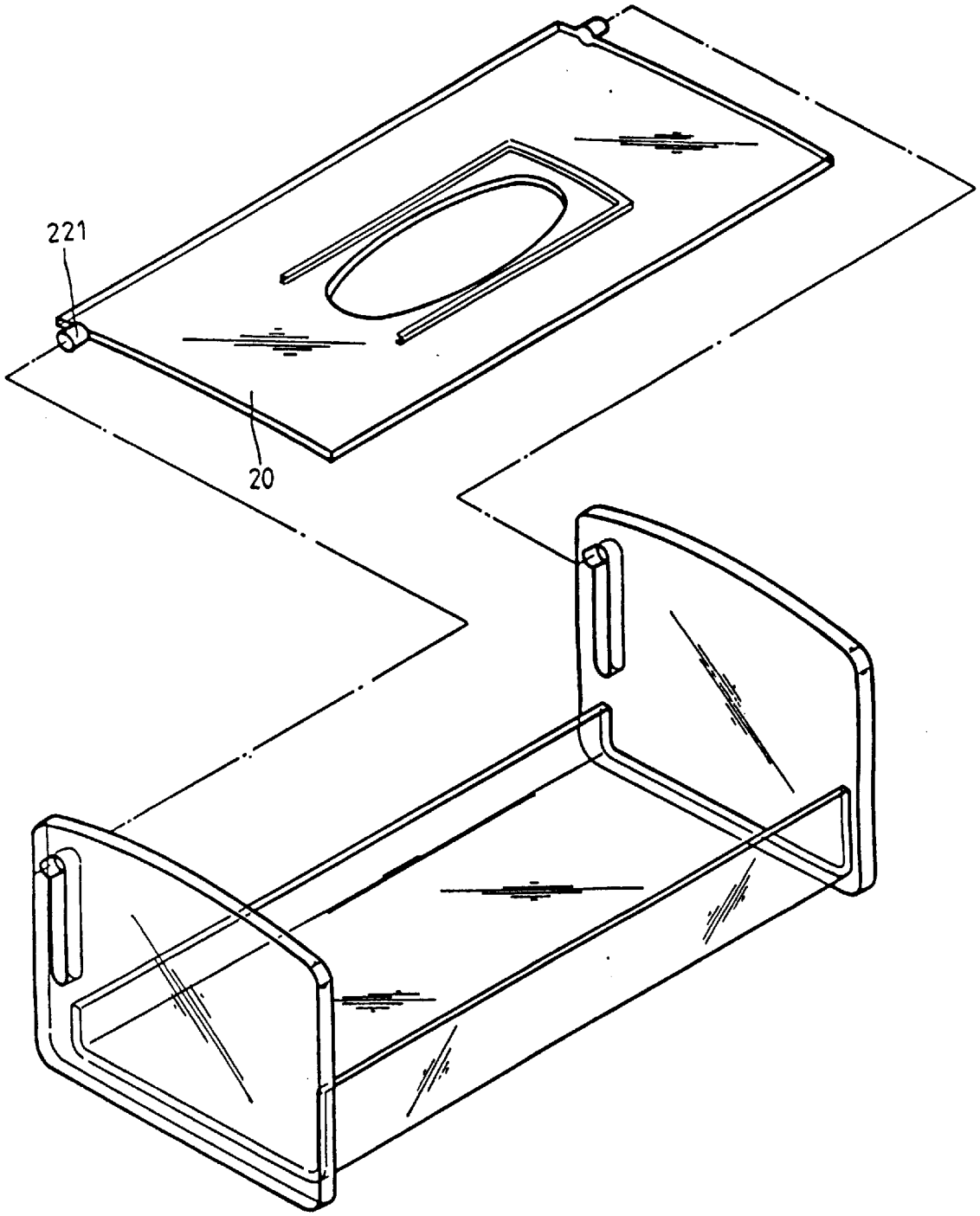
FIG. 8 shows a schematic view of another adjustment rod of the lid of the present invention.

As shown in FIGS. 4, 5, and 8, the movable lid 20 can be lifted to facilitate the depositing of the toilet paper sheets 30 on the base 11 of the main body 10. When the movable lid 20 is joined with the main body 10, the adjustment rod 22 is retained in the slide slot 13 of the main body 10. The adjustment rod 20 may be provided respectively at both ends thereof with a lug 221 which can be rotated in the first slide slot 131.

As the overall volume of the toilet paper 30 contained in the main body 10 is reduced to an extent that there is a substantial distance between the underside of the lid 20 and the topmost sheet of the pile of the toilet paper sheets 30, the movable lid 20 is adjusted such that the adjustment rod 22 of the movable lid 20 is moved from the short slide slot 131 to the second (long) slide slot 132, and that the underside of the movable lid 20 is in contact with the topmost sheet of the pile of the toilet paper sheets 30. As a result, whenever the toilet paper sheet 30 is drawn out via the through hole 21 of the lid 20, the following toilet paper sheet 30 is always partially drawn out of the through hole 21. In addition, the movable lid 20 has an arcuate underside 24 serving to reduce the contact area between the lid 20 and the toilet paper sheet 30 which is being drawn out via the through hole 21. The reduction in the contact area between the lid 20 and the toilet paper sheet 30 can prevent the toilet paper sheet 30 from being torn at the time when the toilet paper sheet 30 is being drawn out via the through hole 21 of the lid 20.

Figure 6:
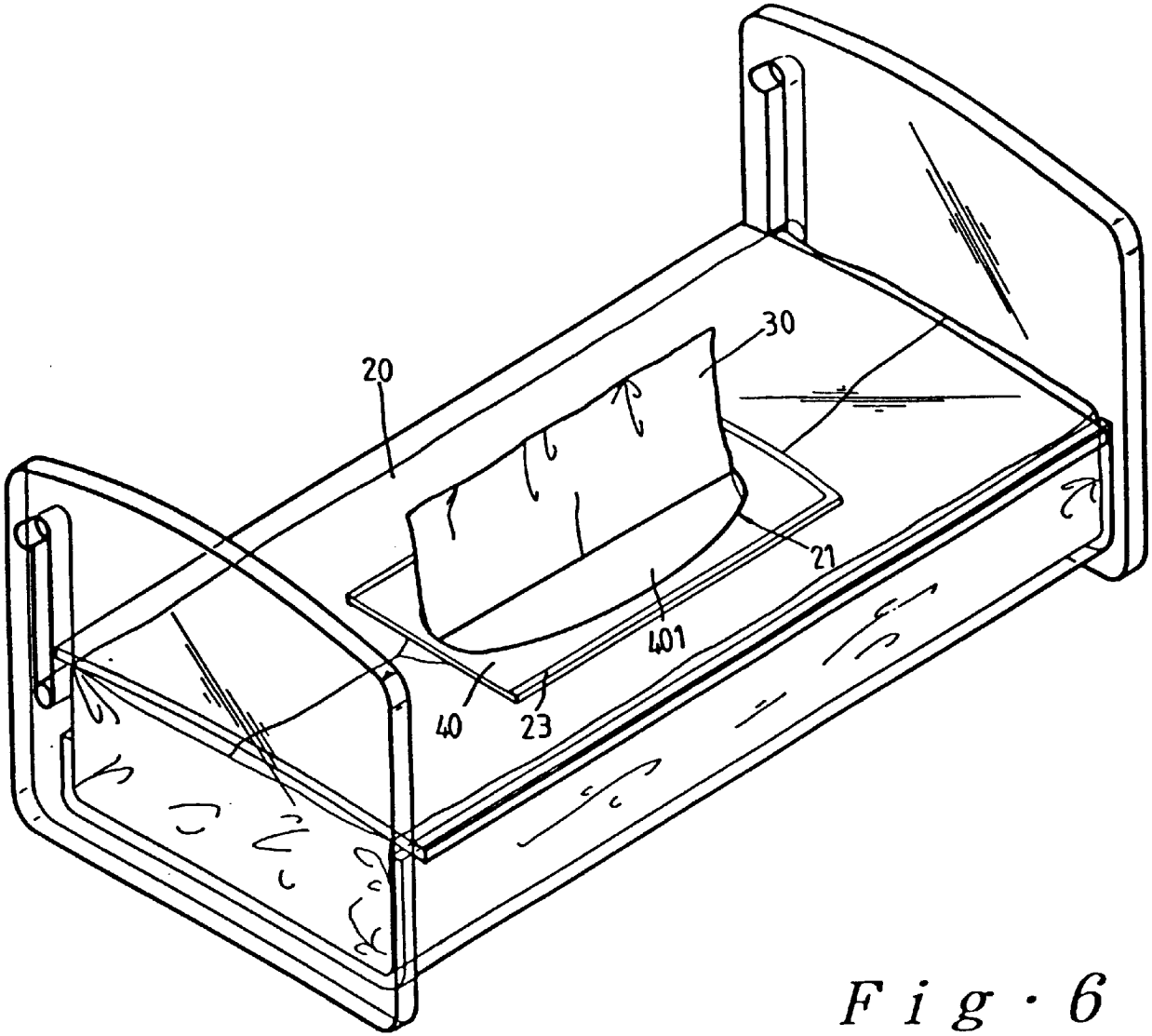
FIG. 6 shows a schematic view of the present invention provided with a thin plate which is retained by the holding slot of the lid of the present invention.

As shown in FIG. 6, the present invention is provided with a thin plate 40 which has a film 401 and is retained by the holding slot 23 of the movable lid 20. The film 401 has a slit through which the toilet paper sheet 30 is drawn out uprightly so as to enhance the chance that the following toilet paper sheet 30 is partially drawn out of the slit of the film 401.

Figure 7:
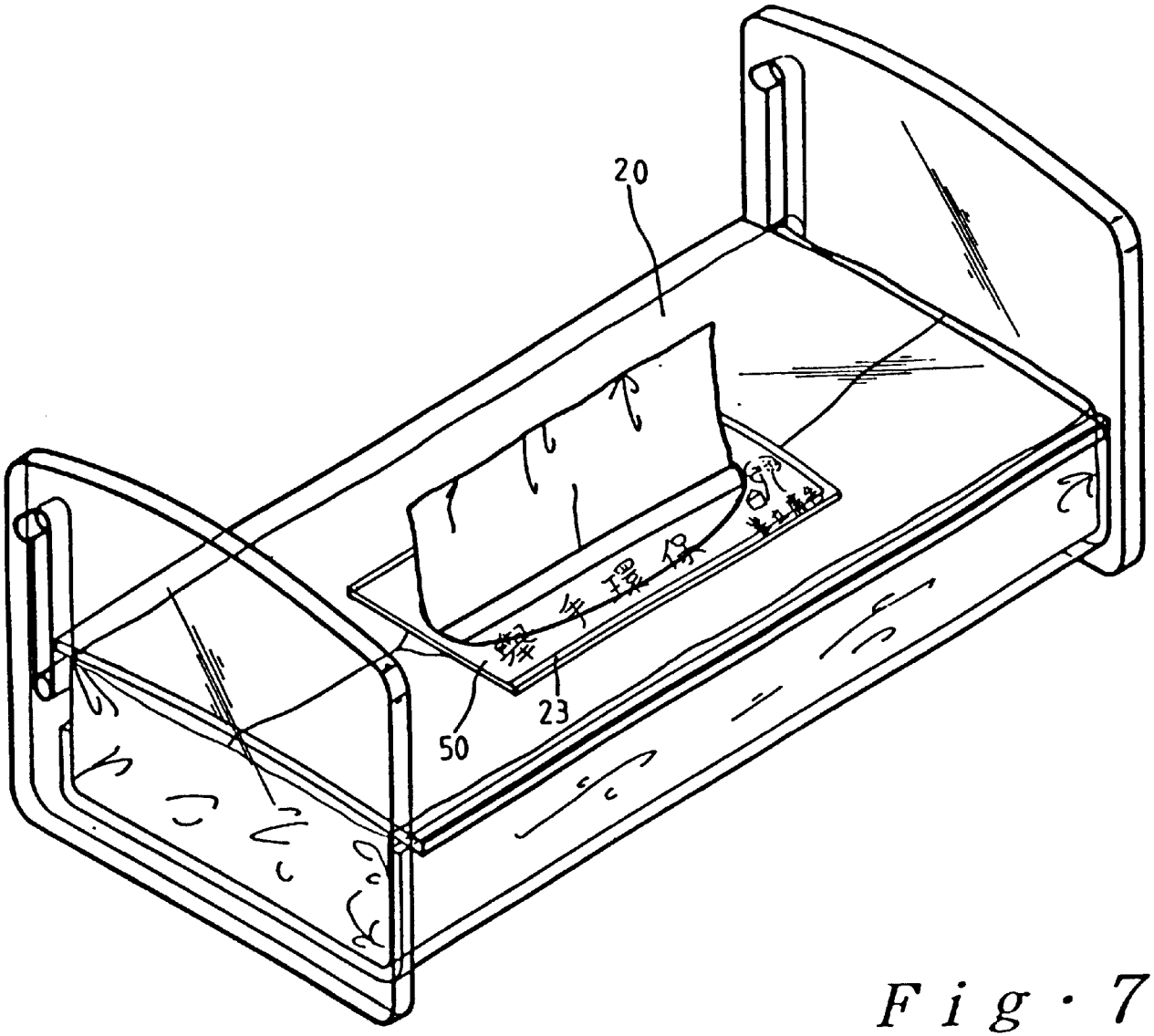
FIG. 7 shows a schematic view of the present invention provided with a label which is retained by the holding slot of the lid of the present invention.

As shown in FIG. 7, the present invention is provided with a label 50 which is retained by the holding slot 23 of the movable lid 20 and has messages printed thereon.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A toilet paper holder comprising:

a main body having a base, a open top, two opposite side plates, and a receiving space defined by said base and said two opposite side plates for receiving a pile of toilet paper sheets which are arranged in a stack such that the toilet paper sheets can be drawn out of said main body one after another, said two opposite side plate provided correspondingly with a short slide slot and a long slide slot; and a movable lid movably joined with said main body such that said movable lid covers said open top of said main body, said movable lid provided with a through hole via which the toilet paper sheets are drawn out of said main body, and an adjustment rod fastened therewith such that both longitudinal ends of said adjustment rod are retained slidable in said short slide slot or said long side slot so as to keep said movable lid in contact with the topmost sheet of the pile of the toilet paper sheets held in said receiving space of said main body.

2. The toilet paper holder as defined in claim 1, wherein said movable lid is provided with a holding slot surrounding said through hole of said movable lid for retaining a thin plate having a film with a slit via which the toilet paper sheets are uprightly drawn out of said main body; and wherein said movable lid is provided with a label which is retained by said holding slot.

3. The toilet paper holder as defined in claim 1, wherein said movable lid has an arcuate underside in contact with the topmost sheet of the pile of the toilet paper sheets held in said receiving space of said main body.

4. The toilet paper holder as defined in claim 1, wherein said longitudinal ends of said adjustment rod are provided with a lug.

* * * * *